US005768829A

United States Patent [19]

Thompson et al.

[11] Patent Number: 5,768,829

[45] Date of Patent: Jun. 23, 1998

[54] METHOD AND APPARATUS FOR A TEMPORARY CORRIDOR

[76] Inventors: Michael G. Thompson; Lee A. Bowman, both of 5847 Cleveland, Morton Grove, Ill. 60053

[21] Appl. No.: 653,148

[22] Filed: May 24, 1996

[51] Int. Cl.[6] ..... E04B 1/32

[52] U.S. Cl. ..... 52/86; 52/33; 52/79.1; 52/79.9; 52/79.5; 52/584.1; 52/81.4; 135/97

[58] Field of Search ..... 52/86, 81.1, 81.4, 52/91.1, 80.1, 79.1, 79.5, 79.6, 79.7, 79.8, 79.9, 33, 4, 584.1, 745.02, 745.07, 745.08; 411/508, 509, 913; 135/97

[56] References Cited

U.S. PATENT DOCUMENTS

| | | | |
|---|---|---|---|
| 2,172,571 | 9/1939 | Theriault | 52/86 X |
| 2,445,552 | 7/1948 | Baxter | 52/584.1 |
| 2,816,329 | 12/1957 | Sogaro | 52/86 |
| 2,828,757 | 4/1958 | Thaxton, Jr. . | |
| 3,059,734 | 10/1962 | Tripp . | |
| 3,200,546 | 8/1965 | Losak | 52/578 X |
| 3,330,080 | 7/1967 | Grieb et al. | 52/86 |
| 3,535,836 | 10/1970 | Blaski . | |
| 3,566,554 | 3/1971 | Schaffer et al. | 52/79.5 X |
| 3,594,964 | 7/1971 | Clark | 52/81.4 X |
| 3,756,115 | 9/1973 | Schuplin | 411/508 |
| 3,803,670 | 4/1974 | Johnson | 411/508 |
| 3,846,943 | 11/1974 | Wagner | 135/906 X |
| 4,023,317 | 5/1977 | Bettger et al. | 52/81.4 |
| 4,255,912 | 3/1981 | Kovacs . | |
| 4,649,676 | 3/1987 | Davey | 52/86 |
| 4,848,046 | 7/1989 | Wallhead | 52/81.4 |
| 4,885,879 | 12/1989 | Plantier . | |
| 5,224,306 | 7/1993 | Cramer | 135/97 X |
| 5,279,085 | 1/1994 | DiPaolo et al. | 52/86 X |
| 5,295,335 | 3/1994 | Collier | 52/86 |
| 5,471,799 | 12/1995 | Smeja et al. | 52/24 |
| 5,540,014 | 7/1996 | Smith | 52/86 X |

FOREIGN PATENT DOCUMENTS

| | | | |
|---|---|---|---|
| 864353 | 4/1941 | France | 52/86 |
| 866149 | 6/1941 | France | 52/86 |
| 2623550 | 5/1989 | France | 52/79.1 |
| 12649 | 8/1956 | Germany | 52/80.2 |
| 3441733 | 7/1985 | Germany | 52/79.1 |
| 3-272308 | 12/1991 | Japan | 411/508 |
| 6-307033 | 11/1994 | Japan | 52/86 |
| 1399420 | 5/1988 | U.S.S.R. | 52/80.2 |
| 580373 | 9/1946 | United Kingdom | 52/86 |
| 631566 | 11/1949 | United Kingdom | 52/86 |
| 1329403 | 9/1973 | United Kingdom | 52/81.1 |

*Primary Examiner*—Wynn E. Wood
*Assistant Examiner*—Laura A. Callo
*Attorney, Agent, or Firm*—Michael R. McKenna

[57] ABSTRACT

A method and apparatus for a temporary corridor, to cover a walkway or the like, comprising easily transportable elements that can be quickly erected and disassembled on a selected site by one person.

11 Claims, 3 Drawing Sheets

METHOD AND APPARATUS FOR A TEMPORARY CORRIDOR

BACKGROUND OF THE INVENTION

The invention relates to a method and apparatus for a temporary corridor for sheltering individuals against adverse weather conditions comprising easily transportable elements that can be quickly erected and disassembled on a selected site.

The temporary corridor should be suitably sized to accommodate individuals and specifically sized to meet the requirements of the Americans With Disabilities Act. It is envisioned that the vertical dimension of the vertical member be approximately six (6) feet from the top section to the bottom section and that the lateral dimension of the horizontal member, measured perpendicular to the side flange, one flange to the other, will be on the order of three and a half (3½) to four (4) feet.

This temporary corridor will be a significant aid to the disabled and elderly during extreme cold, icy and snowy conditions.

It is contemplated that the generally horizontal members and vertical members will be made of appropriate sheet metal which may be galvanized to prevent rust, that the elongated seal will be made of a flexible rubberized material, that the interlocking pins and interlocking pegs will be manufactured from flexibly rigid plastic. Alternatively, the generally horizontal members and vertical members could be made of plastic through an injection molding or extrusion process. That windows in the vertical members will be made of plexiglas or other suitable translucent material. The anchors, as disclosed can be made of either plastic or a metallic material.

Alternative technology is available in the form of various sheltering devices including U.S. Pat. No. 3,059,734 issued to Tripp on Oct. 23, 1962 reveals a fabricated building structure employing self-retaining form fasteners which pass through a slotted opening in the horizontal web of the channel which will lock in place when turned. The principal disadvantage of such a device is that it is not easily disassembled as is the present invention.

A patent to Blaski, U.S. Pat. No. 3,535,836 issued on Oct. 27, 1970, teaches a curved building construction employing roof panels and curved side panels.

U.S. Pat. No. 5,279,085 issued to DiPaolo on Jan. 19, 1994 reveals a covering walkway system for a parking lot. This particular patent does not provide for structural elements that are erected and disassembled as is disclosed in the present invention.

A temporary shelter is disclosed in U.S. Pat. No. 4,255,912 issued to Kovacs on Mar. 17, 1981. However, the shelter units are fully enclosed for temporary building modules.

A vault structure for protection of roadways against snow disclosed in U.S. Pat. No. 4,885,879 issued to Plantier on Dec. 12, 1989 may serve a related function, but the elements are clearly distinguishable requiring concrete foundations supports and a curved skeletal structure over which a covering is provided. Similarly, a pre-fabricated shelter is disclosed in recently issued U.S. Pat. No. 5,295,335 issued to Collier on Mar. 22, 1994, providing a skeletal structure (see particularly FIG. 2) and a covering. The manner in which the elements are combined do not reflect the portable method and structure which is provided for the instant invention.

In U.S. Pat. No. 2,828,757 issued to Thaxton, Jr., on Apr. 1, 1958, a collapsible passageway comprising a skeletal structure and side and rooftop members. Said elements and the means for connection are structurally different from the easily erected and disassembled members of the instant invention.

Some of the drawbacks to these designs are that each teaches a structure which is not easily erected and disassembled. Moreover, none of the foregoing inventions is designed to be anchored impermanently to the ground.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

Unlike the foregoing devices which teach structures that support permanent and semi-permanent sheltering structures, the instant invention is comprised of easily transportable components that are designed to fit easily together, be fastened quickly, and thus easily erected without a substantial investment of time or the use of tools.

The fastening means is primarily a locking pin/peg and an anchor both of which can be installed and removed without tools. The locking pins and pegs, which may be identical, have two legs that are flexible extending from a free end of a shank and a head on the other end. This flexibility allows the free end of the leg of the shank to be inserted into aligned holes of the horizontal member and vertical members respectively to connect one to the other. Moreover, the side flanges which are preferably perpendicular (or alternately, flat and overlapping) to the central rectangular body shape of the vertical member allowing adjacent side sections to be easily joined together by the locking pegs.

The anchors provided have stabilizing radially extending arms which interlock with appropriately disposed holes adjacent to the central aperture in the bottom section of the vertical member for stabilizing the anchor once it is positioned.

Another advantage is that no reinforcing rods are required. The arched characteristic of the generally horizontal member will provide additional strength and about an additional foot of head clearance. Furthermore, the addition of ribs to either or both of the generally horizontal members and the vertical members will provide further strengthening.

The arched horizontal member side flanges will provide additional wind stability. The width of the vertical members that could be produced in one, two, and four foot widths. Vertical members, generally six feet in height, would be produced in four foot widths. The temporary corridor of this important invention may have vertical members with a height greater than six feet, perhaps about six feet six inches, to accommodate irregular site topology with a central sidewalk over which the temporary corridor is erected disposed at a higher elevation than adjacent terrain.

In brief, this temporary corridor of the present invention provides erectable components and fasteners that can be easily transported, erected and disassembled, and yet provide substantial shelter for individuals in need of temporary protection. The temporary corridor is designed to be assembled by one person.

Still other advantages will be apparent from the disclosure that follows.

SUMMARY OF THE INVENTION

The invention relates to a method and apparatus for a temporary corridor for sheltering individuals against adverse weather conditions comprising easily transportable elements that can be quickly erected and disassembled on a selected site. The temporary corridor comprises at least one generally horizontal member. Each of the at least one generally horizontal member is substantially rectangular as seen in plan view. Each generally horizontal member has a first end edge and an oppositely disposed second end edge, a first side flange and an oppositely disposed second side flange. The first side flange and the second side flange each have a predetermined number of holes therethrough.

The temporary corridor further comprises a plurality of vertical members equal in number to twice the number of the at least one generally horizontal member. Each of the vertical members has a generally flat rectangular shape with a peripheral flange comprising a top section, a bottom section, a right side section and a left side section. The top section has a plurality of boreholes corresponding in number and pattern of distribution with the holes of either the first side flange or the second side flange of the horizontal member. Means for connecting the first side flange of each of the at least one generally horizontal member to the top section of one of the vertical members and for connecting the second side flange of each of the horizontal members to which one of said vertical members is connected to the top section of another one of said vertical members is further provided. As connected these elements form at least one corridor unit with the horizontal member on top and at least one of the vertical members extending downwardly from the first side flange and at least one of said vertical members extending downwardly from the second side flange of the horizontal member with the bottom section of each of the respective vertical members disposed toward the site.

In a preferred embodiment of this important invention the means for connecting comprises a plurality of removable locking pins corresponding in number and pattern of distribution with the holes of the first side flange and the second side flange of the horizontal member. Each of the removable locking pins is suitably sized to enter and interlock the holes of the at least one generally horizontal member to the boreholes of the top section of the respective vertical members.

A method for the construction of the temporary corridor is additionally provided comprising the steps of aligning a portion of a first side flange of at least one generally horizontal member to at least a segment of a top section of at least one vertical member; connecting the first side flange of the at least one generally horizontal member to the aligned segment of the top section of the at least one vertical member; aligning a portion of a second side flange of the at least one generally horizontal member to at least a segment of a top section of at least one other vertical member; connecting the portion of the second side flange of the at least one generally horizontal member to the aligned segment of the top section of the at least one other vertical member; and anchoring the bottom section of each of the vertical members to the site.

BRIEF DESCRIPTION OF THE DRAWINGS

Preferred embodiments of the invention are described hereinafter with reference to the accompanying drawing wherein.

DETAILED DESCRIPTION OF THE INVENTION

Figure 1:
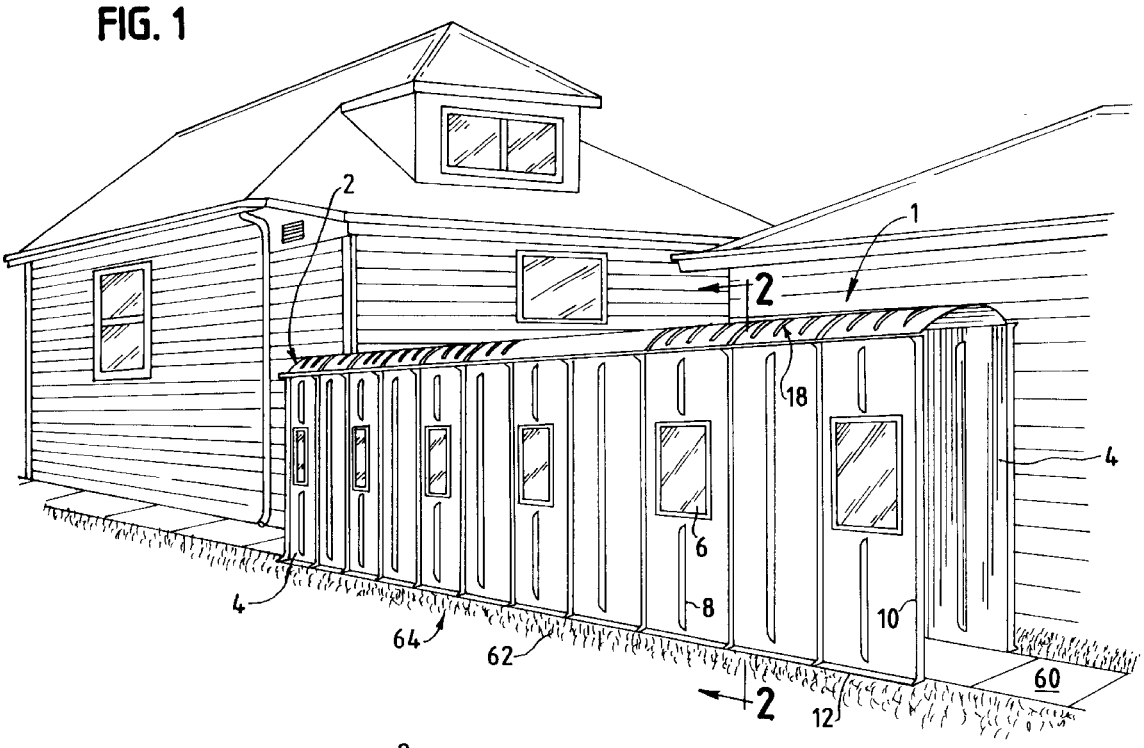
FIG. 1 is a perspective view of the temporary corridor of the present invention showing a plurality of corridor units attached over a sidewalk extending from a house to a garage.
Figure 2:
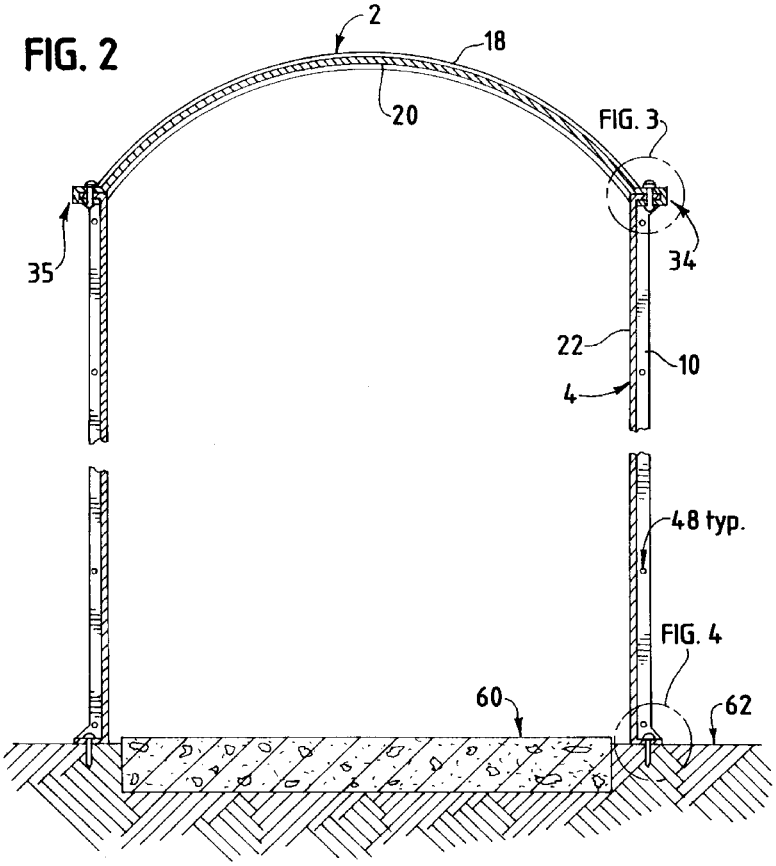
FIG. 2 is a side elevation view taken along the line 2—2 of FIG. 1 of a preferred embodiment of the temporary corridor showing each of the vertical members anchored into the ground and the generally horizontal member having a arched central area with an outwardly convex shape arching upwardly from the respective vertical members to which it is attached.

The discussion that follows, without limiting the scope of the invention, will refer to the invention as depicted in the drawing.

A temporary corridor 1 of easily transportable elements erectable on a selected site for sheltering individuals against adverse weather conditions comprising at least one generally horizontal member 2. Each of the at least one generally horizontal member being substantially rectangular in plan with a first end edge 3 and an oppositely disposed second end edge 5, and a first side flange 34 and an oppositely disposed second side flange 35. The first side flange and the second side flange each being disposed along a length, measured between the first end edge 3 and the second end edge 5.

The temporary corridor further comprises a plurality of vertical members 4. Each of the vertical members having a generally flat rectangular shape 22 with a peripheral flange comprising a top section 16, a bottom section 12, a right side section 10 and a left side section 14. In a preferred embodiment of the present invention, each of the vertical members 4 has a width, measured along the top section 16, that is less by a predetermined amount than the length of the at least one generally horizontal member 2.

Figure 13:
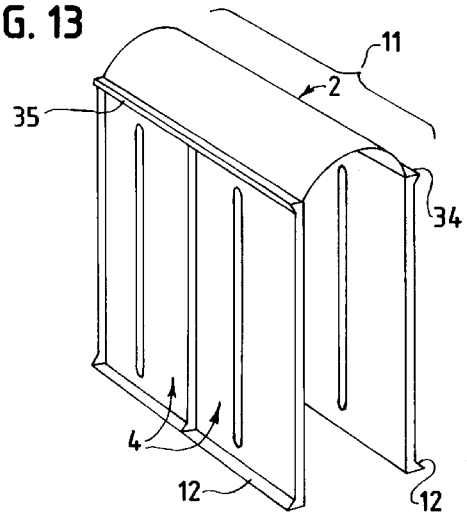
FIG. 13 is a temporary corridor having a horizontal member of sufficient length to connect to the extended top section of two joined vertical members.

The temporary corridor further comprises means for connecting a portion 7 of the first side flange 34 of the at least one generally horizontal member 2 to at least a segment 9 of the top section 16 of at least one of the vertical members 4 that has been placed in alignment with the first side flange 34 and for connecting a portion 7 of the second side flange 35 of the horizontal member to at least a segment 9 of the top section 16 of at least one other of the vertical members 4 that has been placed in alignment with the second side flange 35. Thus forming at least one extended corridor unit 11 of FIG. 13, with the horizontal member 2 on top and at least one of the vertical members 4 extending downwardly from the first side flange 34 and at least one of the vertical members extending downwardly from the second side flange 35 of the horizontal member with the bottom section 12 of each of the respective vertical members disposed toward the site.

Figure 11:
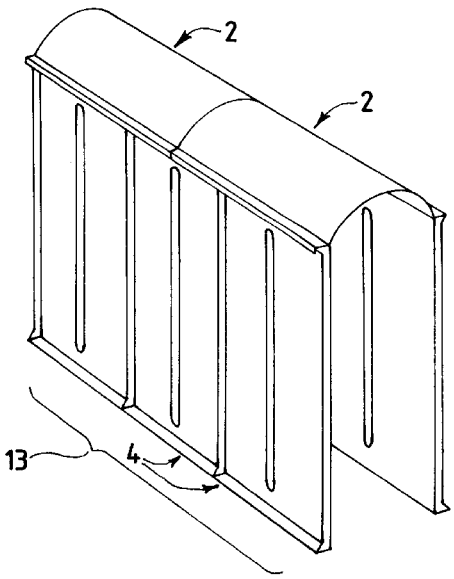
FIG. 11 is a perspective view of an embodiment of the present invention illustrating a temporary corridor with generally horizontal members that extend beyond the top section of an attached vertical member.

In one preferred embodiment of the present invention as shown in FIG. 11, the portion 7 of the first side flange 34 along which each of the at least one of the vertical members downwardly extends is registered opposite a portion 7 of the second side flange 35 along which at least one other of the vertical members downwardly extends.

Figure 12:
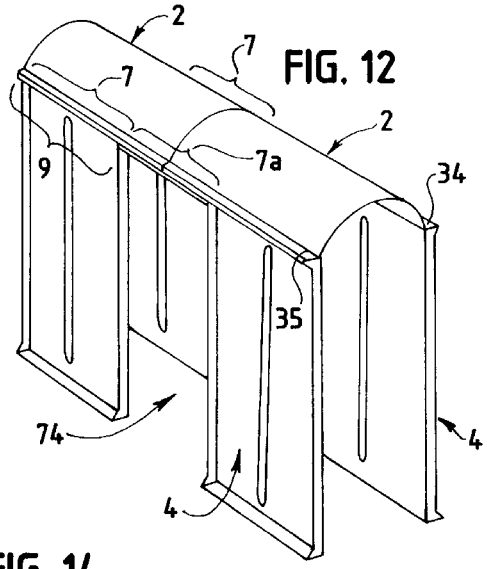
FIG. 12 is a preferred embodiment of the invention shown in FIG. 11 with one of the vertical members removed to create a lateral entrance.

In another preferred embodiment of the present invention as shown in FIG. 12, at least one of the portions 7 of the first side flange 34 along which each of the at least one of the vertical members 4 downwardly extends is registered opposite a portion 7*a* of the second side flange 35 free of one of the vertical members, creating a lateral entrance 74.

As shown in FIGS. 10–15, a preferred embodiment of the present invention for the temporary corridor further comprises means for joining the right side section 10 of one of the vertical members 4 to the left side section 14 of the vertical member 4 aligned with the right side section 10 of one of the vertical members adjacent the left side section of the vertical member creating a series of the vertical members 4 joined together to form an extended side wall 13, as shown in FIG. 11.

Figure 7:
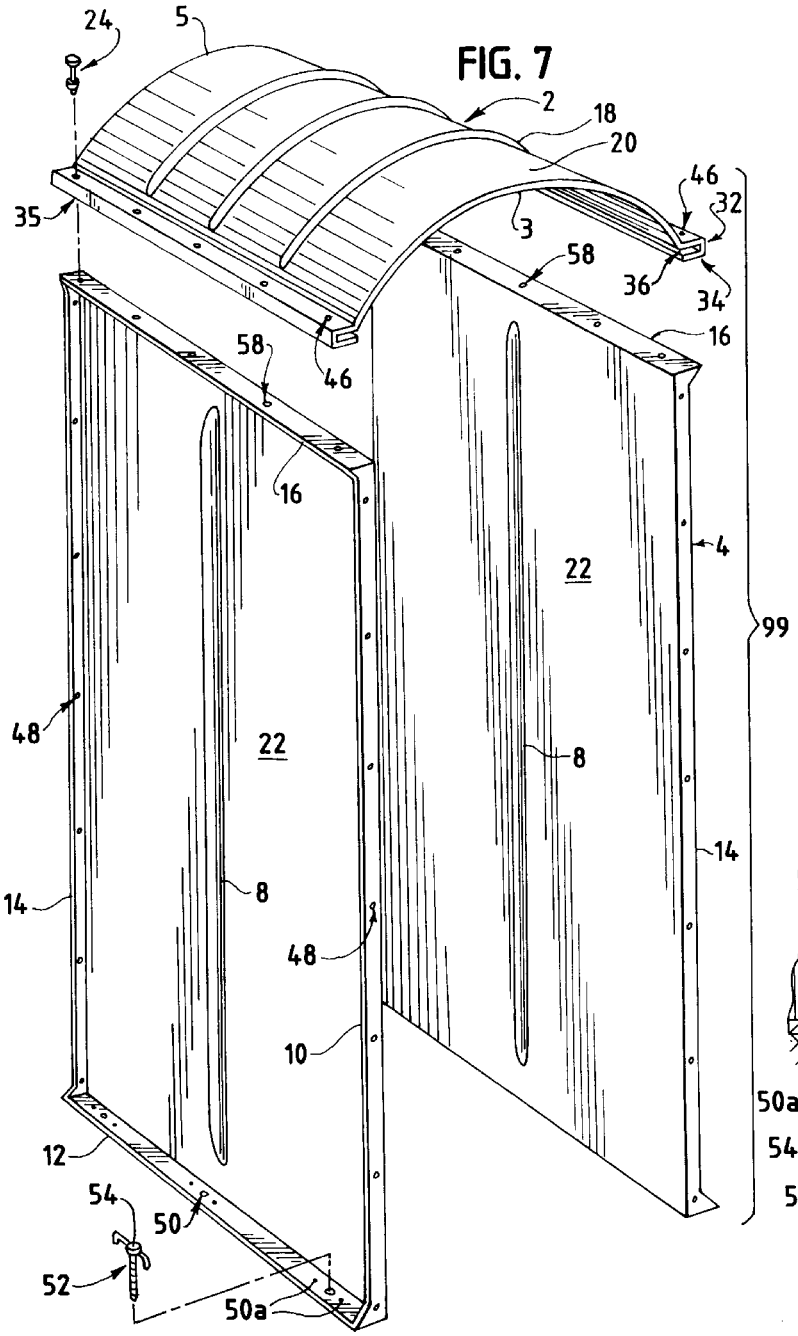
FIG. 7 is an exploded perspective view of a corridor unit of present invention showing the holes, side holes, and apertures of the respective generally horizontal member and vertical member and a locking pin and anchor fastening means.

In a preferred embodiment of the present invention, as shown in FIG. 7, the right side section 10 has a predetermined number of side holes 48 therethrough and the left side section 14 has a plurality of side holes 48 corresponding in number and pattern of distribution with the side holes of the right side section 10 and the means for joining comprises a plurality of removable locking pegs 38 corresponding in number and pattern of distribution with the side holes 48 of the right side section and the left side section of the vertical members 4.

Each of the removable locking pegs 38 is suitably sized to enter and interlock the side holes 48 of right side section 10 of one of the vertical members to the side holes 48 of the left side section 14 of one of the other vertical members aligned therewith.

In a preferred embodiment of the present invention, the removable locking pins 24 are substantially identical and interchangeable with the removable locking pegs 38.

As best shown in FIG. 7 of the drawing, the present invention provides a temporary corridor comprising at least one generally horizontal member 2, substantially rectangular in plan, having a first end edge 3 and an oppositely disposed second end edge 5, and having a first side flange 34 and an oppositely disposed second side flange 35. The first side flange and the second side flange each have a predetermined number of holes 46 therethrough. The temporary corridor further comprises a plurality of vertical members 4 equal in number to twice the number of the at least one generally horizontal member 2, each of the vertical members having a generally flat rectangular shape 22 with a peripheral flange comprising a top section 16, a bottom section 12, a right side section 10 and a left side section 14. The top section has a plurality of boreholes 58 corresponding in number and pattern of distribution with the holes 46 of either the first side flange 34 or the second side flange 35 of the horizontal member 2.

Means for connecting the first side flange 34 of each of the at least one generally horizontal member 2 to the top section 16 of one of the vertical members 4 and for connecting the second side flange 35 of each of the horizontal members to which one of the vertical members is connected to the top section 16 of another one of the vertical members is also provided. This forms at least one corridor unit 99 with the horizontal member on top and at least one of the vertical members extending downwardly from the first side flange and at least one of the vertical members extending downwardly from the second side flange of the horizontal member with the bottom section of each of the respective vertical members disposed toward the site.

The means for connecting comprising a plurality of removable locking pins 24 corresponding in number and pattern of distribution with the holes 46 of the first side flange 34 and the second side flange 35 of the horizontal member 4. Each of the removable locking pins 24 is suitably sized to enter and interlock the holes 46 of the at least one generally horizontal member 2 to the boreholes 58 of the top section 16 of the respective vertical members 4.

In a preferred embodiment of the present invention, the top section 16 is outwardly disposed and transverse to the plane of the generally flat rectangular shape 22 of the vertical member 4. Furthermore, means for connecting the first side flange 34 of one of the at least one generally horizontal member to the top section 16 of one of the vertical members and for connecting the second side flange 35 of the horizontal member to the top section of another one of the vertical members is supplied to form a corridor unit 99 with the horizontal member on top and at least one of the vertical members extending downwardly from the first side flange and at least one of the vertical members extending downwardly from the second side flange of the horizontal member with the bottom section of each of the respective vertical members disposed toward the site.

Figure 3:
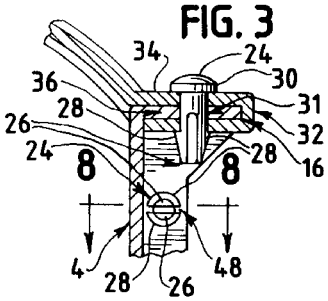
FIG. 3 is an enlarged side elevation view of the connection between a generally horizontal member and one of the vertical members of FIG. 2 showing a preferred flange with a C-shaped cross-section of the horizontal member and perpendicular top section of the vertical member connected by a locking pin having two flexible legs easily disposed therein.

As shown in detail in FIG. 3, a preferred embodiment of the present invention provides that the first side flange 34 and the second side flange 35 each having C-shaped cross section 32 with an elongated opening 36 which is best shown in FIG. 7. The top section 16 is transverse to the plane of the generally flat rectangular shape 22 of the vertical member 4 and is suitably sized to engage the elongated opening 36 of one of the C-shaped cross sections 32 of the first side flange 34 and the second side flange 35.

In a preferred embodiment of the present invention, the means for engaging the first end edge 3, being the border, of one of the at least one generally horizontal member 2 to the second end edge 5 of another one of the at least one generally horizontal member, to reduce introduction of weather elements between the horizontal members. The horizontal members 2 are placed in an end to end relationship, to form an extended roof structure, as shown in FIGS. 10–12, 14 and 15. Whereby, each of the at least one horizontal members may be aligned end to end engaging an adjacent horizontal member.

Figure 6:
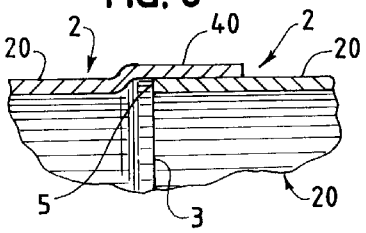
FIG. 6 is a enlarged cross sectional view of the union of two adjacent generally horizontal members showing an elevated border of one horizontal member overlapping an end of an adjacent horizontal member.

In a preferred embodiment of the present invention shown in FIG. 6 of the drawing, the means for engaging comprises an elevated border 40 disposed on the first end edge of the at least one generally horizontal member, at least two of the at least one generally horizontal member 2 are aligned adjacent to each other with the first end edge of each of the horizontal members being disposed in the same direction and with the elevated border 40 of one of the at least one generally horizontal member suitably sized to overlap the adjacent second end edge 5 of the other of the at least one generally horizontal member 2.

Figure 5:
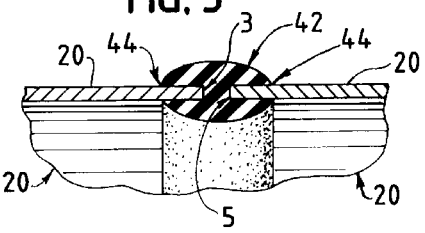
FIG. 5 is an enlarged cross-sectional view of an elongated seal disposed between two adjacent horizontal members, the seal having an eye shaped cross-section identical on each side to permit the respective ends of the horizontal member to be disposed therein.

As shown in FIG. 5, the means for engaging of the instant invention may comprise an elongated seal 42. Additionally, the means for engaging may comprise an elongated connector having an I-shaped cross section 44 with two identical sides, each side being suitably sized to receive an end edge of one of the aligned adjacent at least one generally horizontal member.

Additionally, a preferred embodiment of the present invention, may further provide that the means for joining the right side section of one of the vertical members of one of the corridor units to an adjacent left side section of the vertical member of another corridor unit placed side by side with the right side section of one of the vertical members of one of the corridor units adjacent to the left side section of the vertical member of another corridor unit, whereby a series of the corridor units may be joined together to form an extended the passageway.

Figure 10:
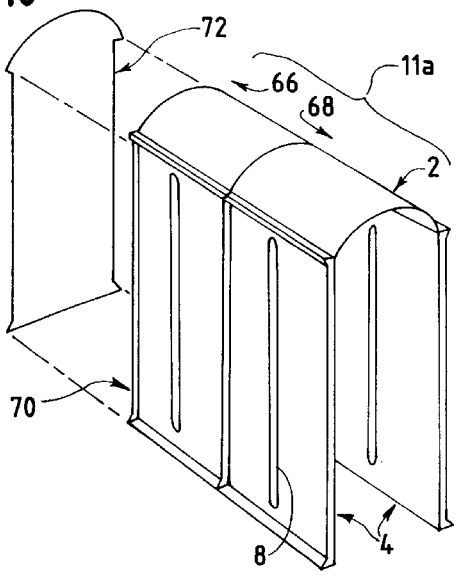
FIG. 10 is an exploded perspective view showing an end panel exploded away from an end opening of two corridor units that have been joined together.

As best shown in FIG. 10 of the drawing, the temporary corridor of the present invention, wherein the corridor unit 9 disposed on an end of the temporary corridor has a proximate end 68 that is connected to another corridor unit 99 and a distal end 66 that is free of engagement to another corridor unit. The distal end of the corridor unit has an end opening 70, and the temporary corridor has an end panel 72 suitably sized to cover the end opening 70.

In a preferred embodiment of the present invention, the bottom section 12 of each of the vertical members 4 is disposed transverse to the generally flat shape 22 of the vertical member and has a predetermined number of apertures 50, as shown in FIG. 7, disposed in the bottom section 12, and the means for anchoring the bottom section of the vertical members to the site 64 comprises a stake 52 having a head 54 disposed on one end with a minimum transverse dimension that is substantially greater than the maximum dimension of the aperture 50.

Moreover, in a preferred embodiment of the present invention, the peripheral flange (comprising a top section 16, a bottom section 12, a right side section 10 and a left side section 14) of each vertical member 4 is perpendicular to the generally flat shape 22 of the vertical member 4.

Figure 4:
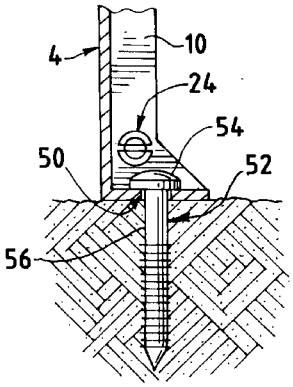
FIG. 4 is an enlarged side elevation view of the anchoring detail of FIG. 2 showing the anchoring arrangement disposed in the bottom section of the peripheral flange of the vertical member.
Figure 8:
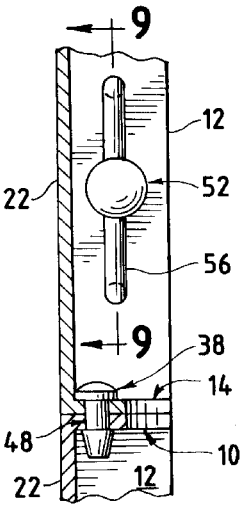
FIG. 8 is a cross-sectional view taken along the line of 8—8 of FIG. 3 showing a preferred embodiment of the temporary corridor displaying a cross-section of a locking peg interlocking a right side section to a left side section of adjacent vertical members and further showing a top plan view of an anchor disposed through an aperture in a bottom section of one of the vertical members showing opposing arms extending radially from the axis of the shank of said anchor, each arm having a terminus that is transverse to the axis of the arm, each of said terminus being disposed in an arm aperture of the bottom section of the vertical member.
Figure 9:
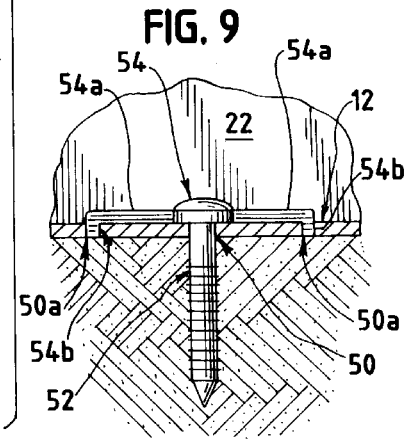
FIG. 9 is a side elevation view taken along the line of 9—9 of FIG. 8 showing a preferred embodiment of the anchor of the present invention with the shank disposed through the bottom of the aperture in the bottom section and into the ground and with the anchor arm extending radially outward with the terminus of said arms extending into the arm apertures of the bottom section of the peripheral flange of the vertical member to provide anchoring stability.

As best shown in FIGS. 3, 4 and 8 of the drawing, a preferred embodiment of the present invention may include the removable locking pins 24 (and pegs 38) having a shank 31 and a generally cylindrical head 30 disposed concentrically on an end of the shank and two flexible legs 26 on the other end of the shank.

Each of the flexible legs 26 has a nub 28 extending outward radially. The flexible legs are movable between a first static position with the nubs extending outward radially a minimum radial dimension that is substantially greater than the minimum dimension of the holes 46 of the at least one generally horizontal member 2 and the boreholes 58 of the top section 16 of the respective vertical members, and a second position in which the flexible legs 26 are compressed together with the nubs 28 extending outward radially a maximum radial dimension that is substantially less than the minimum dimension of the holes 46 of the at least one generally horizontal member 2 and the boreholes 58 of the top section 16 of the respective vertical members 4.

In this way, the flexible legs 26 of the each of the removable locking pins 24 may be pressed together from the first position to the second position as the removable locking pin enters the aligned holes of the at least one generally horizontal member and the boreholes of the top section of the respective vertical members and to interlock the aligned holes of the at least one generally horizontal member and the boreholes of the top section of the respective vertical members when the flexible legs move to the second position to the first position and whereby each of the removable locking pins may be easily removed by manually pressing together the flexible legs thereof from the first position to the second position as the removable locking pin is urged axially out of the aligned holes.

In a preferred embodiment of the present invention, as best shown in FIG. 7, a central section 20 disposed between the first side flange 34 and the second side flange 35 of each of the at least one generally horizontal member 2 arches upwardly forming a portion of a cylinder.

Figure 14:
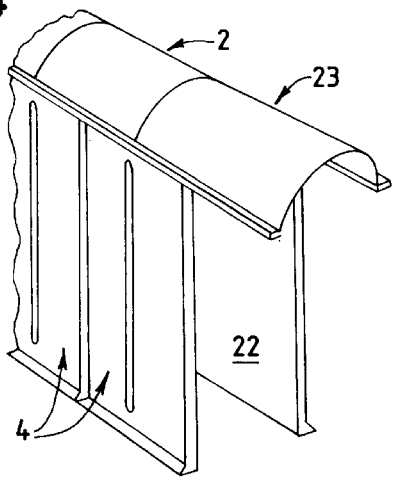
FIG. 14 illustrates a preferred embodiment of the present invention with an extended awning comprising an extending horizontal member having a longitudinal slope away from the entrance so that rain water or other liquids are moved away from the entrance end.
Figure 15:
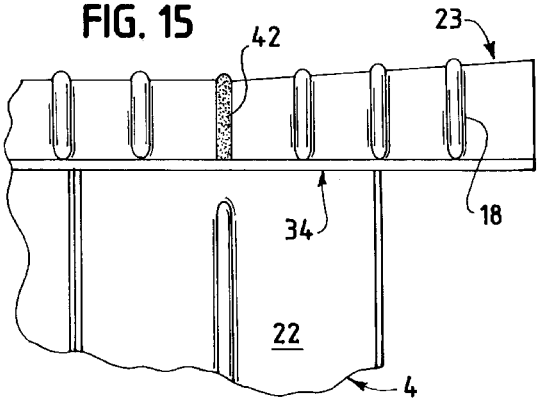
FIG. 15 is a side elevation view of the preferred embodiment of FIG. 14 showing additional strengthening ribs disposed in the generally horizontal members and further showing an elongated seal disposed between adjacent horizontal members.

In a preferred embodiment of the present invention, as best shown in FIGS. 14 and 15, a central section disposed between the first side flange and the second side flange of each of the at least one generally horizontal member arches upwardly forming a portion of frustum of a cone 23.

In a preferred embodiment of the present invention, as best shown in FIGS. 1, 10 and 11 of the drawing, a preferred embodiment of the present invention provides that each of the at least one generally horizontal member 2 has a dimension measured along one of the first side flange 34 and the second side flange 35 between the first end 3 and the second end 5 that does not substantially exceed a width of each of the vertical members 4, measured along the top section 16.

As shown in FIG. 1, the temporary corridor may have at least one of the vertical members 4 with a window 6 disposed in the generally flat rectangular shape 22 thereof. And at least one of the at least one generally horizontal member 2 and the vertical members 4 may have a reinforcing rib 8 for added strength.

In a preferred embodiment of the present invention, a temporary corridor of easily transportable elements erectable on a selected site for sheltering individuals against adverse weather conditions comprises at least one generally horizontal member 2. Each of the at least one generally horizontal member is substantially rectangular in plan and has a first end edge 3 and an oppositely disposed second end edge 5, and has a first side flange 34 and an oppositely disposed second side flange 35. The first side flange and the second side flange each having a C-shaped cross section 32 with an elongated opening 36 and a predetermined number of holes 46 therethrough.

This temporary corridor further comprises a plurality of vertical members 4 equal in number to twice the number of the at least one generally horizontal member 2. Each of the vertical members 4 has a generally flat rectangular shape 22 with a peripheral flange comprising a top section 16, a bottom section 12, a right side section 10 and a left side section 14. The top section is transverse to the plane of the generally flat rectangular shape 22 of the vertical member 4 and is suitably sized to engage the elongated opening 36 of one of the C-shaped openings of the first side flange 34 and the second side flange 35 and has a plurality of boreholes 58 corresponding in number and pattern of distribution with the holes 46 of either the first side flange 34 or the second side flange 35 of the horizontal member.

This temporary corridor further comprises means for connecting the first side flange of each of the at least one generally horizontal member to the top section of one of the vertical members and for connecting the second side flange of each of the horizontal members to which one of the vertical members is connected to the top section of another one of the vertical members, to form at least one corridor unit 99 with the horizontal member on top and at least one of the vertical members extending downwardly from the first side flange and at least one of the vertical members extending downwardly from the second side flange of the horizontal member with the bottom section of each of the respective vertical members disposed toward the site. The means for connecting comprising a plurality of removable locking pins 24 corresponding in number and pattern of distribution with the holes 46 of the first side flange and the second side flange of the horizontal member. Each of the removable locking pins being suitably sized to enter and interlock the holes 46 of the at least one generally horizontal member to the boreholes 58 of the top section of the respective vertical members.

This temporary corridor further comprises means for engaging the first end edge of one of the at least one generally horizontal member to the second end edge of another one of the at least one generally horizontal member, to reduce introduction of weather elements between the horizontal members. The horizontal members is placed in an end to end relationship, to form an extended roof structure. Whereby, each of the at least one horizontal members may be aligned end to end engaging an adjacent horizontal member.

This temporary corridor further comprises means for joining the right side section 10 of one of the vertical members of one of the corridor units 99 to an adjacent left side section 14 of the vertical member of another corridor unit placed side by side with the right side section of one of the vertical members of one of the corridor units adjacent to the left side section of the vertical member of another corridor unit. Whereby a series of the corridor units may be joined together to form an extended the passageway.

In a preferred embodiment of the present invention, the means for engaging comprises an elongated means for sealing.

In the temporary corridor of the present invention, means for anchoring the bottom section of the vertical members to the site may be provided.

A preferred method for the construction of a temporary corridor by the simple and fast assembly, on a selected site, of a set of easily transportable modular elements of the present invention comprises the steps of: a. aligning a portion of a first side flange of at least one generally horizontal member to at least a segment of a top section of at least one vertical member, each of the vertical members having a generally flat rectangular shape with a peripheral flange comprising a top section, a bottom section, a right side section and a left side section; b. connecting the portion of the first side flange of the at least one generally horizontal member to the aligned segment of the top section of the at least one vertical member; c. aligning a portion of a second side flange of the at least one generally horizontal member to at least a segment of a top section of at least one other vertical member; d. connecting the portion of the second side flange of the at least one generally horizontal member to the aligned segment of the top section of the at least one other vertical member; and e. anchoring the bottom section of each of the vertical members to the site.

In another preferred method for the construction of a temporary corridor by the simple and fast assembly, on a selected site, of a set of easily transportable modular elements comprising the steps of: a. aligning a first side flange of one of a plurality of generally horizontal members to the top section of at least one vertical member, each of the at least one vertical member having a generally flat rectangular shape with a peripheral flange comprising a top section, a bottom section, a right side section and a left side section; b. connecting the first side flange of the one of a plurality generally horizontal members to the aligned top section of the at least one vertical member; c. aligning a second side flange of the one of a plurality of generally horizontal members to the top section of one other at least vertical member; d. connecting the second side flange of the one of a plurality of generally horizontal members to the aligned top section of the one other at least one vertical member, to form a corridor unit.

The foregoing method for the construction of a temporary corridor may include the additional step of anchoring the bottom section of each of the vertical members to the site.

In another preferred method for the construction of a temporary corridor by the simple and fast assembly, on a selected site, of a set of easily transportable modular elements of the present invention comprises the steps of: a. aligning a first side flange of one of a plurality of generally horizontal members to the top section of at least one vertical member, each of the at least one vertical member having a generally flat rectangular shape with a peripheral flange comprising a top section, a bottom section, a right side section and a left side section; b. connecting the first side flange of the one of a plurality generally horizontal members to the aligned top section of the at least one vertical member; c. aligning a second side flange of the one of a plurality of generally horizontal members to the top section of one other at least vertical member; d. connecting the second side flange of the one of a plurality of generally horizontal members to the aligned top section of the one other at least one vertical member, to form a corridor unit; e. repeating steps a. through d. to form a plurality of corridor units; f. registering a first one of the plurality of corridor units in a straight line with a second one of the plurality of corridor units with the right side section of one of the at least one vertical member of the first one of the corridor units abutting the left side section of one of the at least one vertical member of the second one of the corridor units and with the left side section of the other at least one vertical member of the first one of the corridor units abutting the right side section of the other of the at least one vertical member of the second one of the corridor units; g. joining the right side section of the first one of the corridor units to the abutting left side section of one of the at least one vertical member of the second one of the corridor units and joining the left side section of the other at least one vertical member of the first one of the corridor units to the abutting right side section of the other of the at least one vertical member of the second one of the corridor units, to form at least one extended corridor unit with the horizontal member on top and at least one of the vertical members extending downwardly from the first side flange and at least one of the vertical members extending downwardly from the second side flange of the horizontal member with the bottom section of each of the respective vertical members disposed toward the site; and h. repeating steps f. through g. (N −2) times where N equals in number the number of the plurality of generally horizontal members, to form an extended corridor unit with each of the plurality of horizontal members on top and at least one of the vertical members extending downwardly from the first side flange and at least one of the vertical members extending downwardly from the second side flange of each of the plurality of horizontal members with the bottom section of each of the respective vertical members disposed toward the site.

Furthermore, another preferred method for the construction of a temporary corridor may include the additional step of anchoring the bottom section of each of the vertical members to the site.

The invention resides not in any one of these features per se, but rather in the particular combination of all of them herein disclosed and claimed and it is distinguished from the prior art in this particular combination of all of its structures for the function specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is base, may readily be utilized as a basis for the designing of other structures, methods and systems for carrying out the several purposes of the present invention. It is important, therefore, that the claims be regarded as including such equivalent constructions insofar as they do not depart from the spirit and scop of the present invention.

Further, the purpose of the foregoing abstract is to enable the U.S. patent and Trademark Office and the public generally, and especially the scientist, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is tit intended to be limiting as to the scope of the invention in any way.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

What is claimed as being new and desired to be protected by Letters Patent of the United States is a follows:

1. A temporary corridor of easily transportable elements erectable on a selected site for sheltering individuals against adverse weather conditions comprising:

a. at least one generally horizontal member, each of said at least one generally horizontal member being substantially rectangular in plan, having a first end edge and an oppositely disposed second end edge, and a first side flange and an oppositely disposed second side flange, said first end edge and said second end edge, each being free of a transverse flange with perforations, said first side flange and said second side flange each having a top surface and a bottom surface, both surfaces being generally horizontal and being disposed along a length, measured between the first end edge and the second end edge;

b. a plurality of vertical members, each of said vertical members having a generally flat rectangular shape with a peripheral flange comprising a top section, a bottom section, a right side section and a left side section, each of said vertical members having a width, measured along the top section, that is less by a predetermined amount than the length of said at least one generally horizontal member; and c. means for connecting a portion of the first side flange of said at least one generally horizontal member to at least a segment of the too section of at least one of said vertical members that has been placed in alignment with said first side flange and for connecting a portion of the second side flange of said horizontal member to at least a segment of the top section of at least one other of said vertical members that has been placed in alignment with said second side flange, to form at least one extended corridor unit with the horizontal member on top and at least one of said vertical members extending downwardly from the first side flange and at least one of said vertical members extending downwardly from the second side flange of the horizontal member, said vertical members supporting the horizontal member with the bottom section of each of the respective vertical members disposed toward the site; and wherein at least one of the portions of the first side flange along which each of said at least one of said vertical members downwardly extends is registered opposite a portion of the second side flange free of one of said vertical members, whereby, a lateral entrance is provided.

2. A temporary corridor of easily transportable elements erectable on a selected site for sheltering individuals against adverse weather conditions comprising:

a. at least one generally horizontal member, each of said at least one generally horizontal member being substantially rectangular in plan, having a first end edge and an oppositely disposed second end edge, and a first side flange and an oppositely disposed second side flange, said first end edge and said second end edge, each being free of a transverse flange with perforations, said first side flange and said second side flange each having a top surface and a bottom surface, both surfaces being generally horizontal and being disposed along a length, measured between the first end edge and the second end edge;

b. a plurality of vertical members, each of said vertical members having a generally flat rectangular shape with a peripheral flange comprising a top section, a bottom section, a right side section and a left side section, each of said vertical members having a width, measured along the top section, that is less by a predetermined amount than the length of said at least one generally horizontal member;

c. means for connecting a portion of the first side flange of said at least one generally horizontal member to at least a segment of the top section of at least one of said vertical members that has been placed in alignment with said first side flange and for connecting a portion of the second side flange of said horizontal member to at least a segment of the top section of at least one other of said vertical members that has been placed in alignment with said second side flange, to form at least one extended corridor unit with the horizontal member on top and at least one of said vertical members extending downwardly from the first side flange and at least one of said vertical members extending downwardly from the second side flange of the horizontal member, said vertical members supporting the horizontal member with the bottom section of each of the respective vertical members disposed toward the site; and d. means for joining the right side section of one of the vertical members to the left side section of the vertical member aligned with the right side section of one of the vertical members adjacent the left side section of the vertical member, whereby a series of said vertical members may be joined together to form an extended side wall.

3. The temporary corridor of claim 2, wherein said right side section has a predetermined number of side holes therethrough and said left side section has a plurality of side holes corresponding in number and pattern of distribution with the side holes of the right side section; and wherein the means for joining comprises a plurality of removable locking pegs corresponding in number and pattern of distribution with the side holes of the right side section and the left side section of the vertical members, each of said removable locking pegs which can be utilized independent of tools being suitably sized to enter and interlock the side holes of right side section of one of said vertical members to the side holes of the left side section of one of the other vertical members aligned therewith.

4. The temporary corridor of claim 3, wherein the means for connecting comprises removable locking pins that are substantially identical and interchangeable with the removable locking pegs, both of which can be utilized independent of tools.

5. A temporary corridor of easily transportable elements erectable on a selected site for sheltering individuals against adverse weather conditions comprising:

a. at least one generally horizontal member, each of said at least one generally horizontal member being substantially rectangular in plan, having a first end edge and an oppositely disposed second end edge, and having a first side flange and an oppositely disposed second side flange, said first side flange and said second side flange each having a C-shaped cross section with an elongated opening, said opening facing a generally horizontal plane;

b. a plurality of vertical members equal in number to twice the number of said at least one generally horizontal member, each of said vertical members having a generally flat rectangular shape with a peripheral flange comprising a top section, a bottom section, a right side section and a left side section, said top section being transverse to the plane of the generally flat rectangular shape of the vertical member and being suitably sized to engage the elongated opening of one of the C-shaped cross sections of the first side flange and the second side flange; and c. means for connecting the first side flange of one of said at least one generally horizontal member to the top section of one of said vertical members and for connecting the second side flange of said horizontal member to the top section of another one of said vertical members, to form a corridor unit with the horizontal member on top and at least one of said vertical members extending downwardly from the first side flange and at least one of said vertical members extending downwardly from the second side flange of the horizontal member, said vertical members supporting the horizontal member with the bottom section of each of the respective vertical members disposed toward the site.

6. A temporary corridor of easily transportable elements erectable on a selected site for sheltering individuals against adverse weather conditions comprising:

a. at least one generally horizontal member, each of said at least one generally horizontal member being substantially rectangular in plan, having a first end edge and an oppositely disposed second end edge, and having a first side flange and an oppositely disposed second side flange, said first end edge and said second end edge, each being free of a transverse flange with perforations, said first side flange and said second side flange each having a predetermined number of holes therethrough;

b. a plurality of vertical members equal in number to twice the number of said at least one generally horizontal member, each of said vertical members having a generally flat rectangular shape with a peripheral flange comprising a top section, a bottom section, a right side section and a left side section, said top section having a plurality of boreholes corresponding in number and pattern of distribution with the holes of either the first side flange or the second side flange of the horizontal member; and c. means for connecting the first side flange of each of said at least one generally horizontal member to the top section of one of said vertical members and for connecting the second side flange of each of said horizontal members to which one of said vertical members is connected to the top section of another one of said vertical members, to form at least one corridor unit with the horizontal member on top and at least one of said vertical members extending downwardly from the first side flange and at least one of said vertical members extending downwardly from the second side flange of the horizontal member, said vertical members supporting the horizontal member with the bottom section of each of the respective vertical members disposed toward the site, said means for connecting comprising a plurality of removable locking pins corresponding in number and pattern of distribution with the holes of the first side flange and the second side flange of the horizontal member, each of said removable locking pins being suitably sized to enter and interlock the holes of the at least one generally horizontal member to the boreholes of the top section of the respective vertical members; and further comprising:

d. means for engaging the first end edge of one of said at least one generally horizontal member to the second end edge of another one of said at least one generally horizontal member, to reduce introduction of weather elements between said horizontal members, said horizontal members being placed in an end to end relationship, to form an extended roof structure, whereby, each of said at least one horizontal members may be aligned end to end engaging an adjacent horizontal member.

7. The temporary corridor of claim 6, wherein the means for engaging comprises an elevated border disposed on the first end edge of said at least one generally horizontal member, and wherein at least two of said at least one generally horizontal member are aligned adjacent to each other with the first end edge of each of said horizontal members being disposed in the same direction and with the elevated border of one of said at least one generally horizontal member being suitably sized to overlap the adjacent second end edge of the other of said at least one generally horizontal member.

8. The temporary corridor of claim 6, wherein the means for engaging comprises an elongated seal.

9. The temporary corridor of claim 6, wherein the means for engaging comprises an elongated connector having an I-shaped cross section with two identical sides, each side being suitably sized to receive an end edge of one of said aligned adjacent at least one generally horizontal member.

10. A temporary corridor of easily transportable elements erectable on a selected site for sheltering individuals against adverse weather conditions comprising:

a. at least one generally horizontal member, each of said at least one generally horizontal member being substantially rectangular in plan, having a first end edge and an oppositely disposed second end edge, and having a first side flange and an oppositely disposed second side flange, said first end edge and said second end edge, each being free of a transverse flange with perforations, said first side flange and said second side flange each having a predetermined number of holes therethrough;

b. a plurality of vertical members equal in number to twice the number of said at least one generally horizontal member, each of said vertical members having a generally flat rectangular shape with a peripheral flange comprising a top section, a bottom section, a right side section and a left side section, said top section having a plurality of boreholes corresponding in number and pattern of distribution with the holes of either the first side flange or the second side flange of the horizontal member; and c. means for connecting the first side flange of each of said at least one generally horizontal member to the top section of one of said vertical members and for connecting the second side flange of each of said horizontal members to which one of said vertical members is connected to the top section of another one of said vertical members, to form at least one corridor unit with the horizontal member on top and at least one of said vertical members extending downwardly from the first side flange and at least one of said vertical members extending downwardly from the second side flange of the horizontal member, said vertical members supporting the horizontal member with the bottom section of each of the respective vertical members disposed toward the site, said means for connecting comprising a plurality of removable locking pins corresponding in number and pattern of distribution with the holes of the first side flange and the second side flange of the horizontal member, each of said removable locking pins being suitably sized to enter and interlock the holes of the at least one generally horizontal member to the boreholes of the top section of the respective vertical members; and further comprising means for joining the right side section of one of the vertical members of one of the corridor units to an adjacent left side section of the vertical member of another corridor unit placed side by side with the right side section of one of the vertical members of one of the corridor units adjacent to the left side section of the vertical member of another corridor unit, whereby a series of said corridor units may be joined together to form an extended passageway.

11. The temporary corridor of claim 10, wherein the corridor unit disposed on an end of the temporary corridor has a proximate end that is connected to another corridor unit and a distal end that is free of engagement to another corridor unit, said distal end of said corridor unit having an end opening; and further comprising an end panel suitably sized to cover the end opening.

* * * * *